US005355935A

United States Patent [19]

Nogues

[11] Patent Number: 5,355,935

[45] Date of Patent: Oct. 18, 1994

[54] METHOD AND DEVICE FOR VIBRATING AN INGOT MOULD FOR THE CONTINUOUS CASTING OF METALS

[75] Inventor: Michel Nogues, Lafitte, France

[73] Assignee: Institut de Recherches de La Siderurgie Francaise (IRSID), Puteaux, France

[21] Appl. No.: 21,178

[22] Filed: Feb. 22, 1993

Related U.S. Application Data

[63] Continuation of Ser. No. 534,646, Jun. 7, 1990, abandoned.

[30] Foreign Application Priority Data

Jun. 12, 1989 [FR] France ..... 89 07839

[51] Int. Cl.[5] ..... B22D 11/04

[52] U.S. Cl. ..... 164/416; 164/428; 164/478

[58] Field of Search ..... 164/416, 71.1, 478, 164/428, 418

[56] References Cited

U.S. PATENT DOCUMENTS

| | | | |
|---|---|---|---|
| 3,208,112 | 9/1965 | Scribner | 164/478 |
| 3,270,376 | 9/1966 | Thalmann | 164/416 |
| 3,669,182 | 6/1972 | Wang | 164/416 |
| 4,274,472 | 6/1981 | Cazaux | 164/416 |
| 4,291,742 | 9/1981 | Korytov | 164/416 |
| 4,460,034 | 7/1984 | Saeki et al. | 164/478 |
| 4,691,757 | 9/1987 | Polanschütz | 164/416 |
| 4,986,339 | 1/1991 | Miyazawa | 164/480 |

FOREIGN PATENT DOCUMENTS

| | | | |
|---|---|---|---|
| 3515170 | 11/1985 | Fed. Rep. of Germany . | |
| 56-11150 | 2/1981 | Japan . | |
| 57-62842 | 4/1982 | Japan | 164/416 |
| 58-29553 | 2/1983 | Japan . | |
| 59-197349 | 11/1984 | Japan | 164/416 |
| 60-166146 | 8/1985 | Japan . | |
| 60-170559 | 9/1985 | Japan . | |
| 62-127143 | 6/1987 | Japan . | |

*Primary Examiner*—P. Austin Bradley
*Assistant Examiner*—Rex E. Pelto
*Attorney, Agent, or Firm*—Cushman, Darby & Cushman

[57] ABSTRACT

The invention relates to a process for the continuous casting of metals of the type according to which ultrasonic vibrations are applied to the wall of the ingot mould, characterized in that the vibrations comprise both a component which is oriented parallel to and a component which is oriented perpendicular to the axis of the ingot mould. This method is preferably implemented by applying at least one ultrasound emitter against a surface integral with one of the ends of the ingot mould and with an angle of inclination relative to the axis of the latter. The invention is principally applicable to the continuous casting of steel products of all sizes.

13 Claims, 2 Drawing Sheets

METHOD AND DEVICE FOR VIBRATING AN INGOT MOULD FOR THE CONTINUOUS CASTING OF METALS

This is a continuation-in-part of application Ser. No. 07/534,646, filed on Jun. 7, 1990, now abandoned.

FIELD OF THE INVENTION

The present invention relates to the vibrating of an ingot mould for the continous casting of metals, of the type comprising emitters transmitting ultrasonic vibrations to the wall of the ingot mould.

DESCRIPTION OF THE PRIOR ART

The surface quality of a metal, particularly steel, product which is continuously cast depends, to a very large extent, on the manner of solidifying the first skin of this product from the free surface of the molten metal in the ingot mould (surface generally termed meniscus). Similarly, one of the problems encountered in the continuous casting of metals, particularly steel, whether this is of the "open stream" or "submerged nozzle" type, is that of the attaching or of the sticking, to the inner face of the ingot mould, of the solidified crust resulting from the peripheral solidification of the cast metal bar in contact with the actively cooled wall of the ingot mould. Due to this attaching, tears in the solidified crust may be formed during the progression of the bar in the ingot mould, giving rise to breakouts.

One of the techniques known hitherto for improving this surface quality and avoiding these breakouts consists in reducing the coefficient of friction between the solidified crust and the inner face of the wall of the ingot mould by transmitting ultrasonic vibrations to this wall, particularly in the region of the meniscus. Due to the power levels required, piezoelectric ultrasound emitters are preferably used.

These ultrasonic vibrations may be transmitted by means of one or more emitters applied against the outer faces of the lateral walls of the ingot mould. In this case, the vibrations follow a direction which is substantially perpendicular to the casting axis and the transverse pressure wave propagating in the wall of the ingot mould deforms it by flexion in this same direction. This is the case, for example, in documents FR 2,497,130 and JP 62-127,143. This emitter or these emitters may also be applied against the upper edge or the lower edge of the ingot mould. The vibrations transmitted to the ingot mould in a direction parallel to the casting axis propagate a longitudinal pressure wave in the ingot mould in this same direction, which is generally stationary and gives rise to deformations through local swellings in the wall. The European Patent EP 0,178,967, in the name of the Applicant, presents one example of such a configuration as does U.S. Pat. No. 4,691,757 to Polanschütz.

The excitation of the ingot mould in a purely transverse direction relative to its axis runs into certain problems. The ultrasound emitters must be positioned as close as possible to the inner surface of the ingot mould so that a sufficient part of the vibration energy they produce is effectively transmitted to the surface in contact with the cast product. Usually, the emitters have to pass through the sleeved part used for cooling the ingot mould, the construction of which is thus made more complicated. It is even commonplace to have locally to reduce the thickness of the wall of the ingot mould in the zone in which the emitter is positioned, as is the case in the already cited document FR 2,497,130. Moreover, it is thus much more difficult to equip the ingot mould with an electromagnetic stirrer for agitating the molten metal. The adaptation of such emitters to an existing ingot mould can be envisaged only with difficulty. Moreover, the metallurgical efficiency of these vibrations is closely related to the stability of the level of the meniscus which must be kept permanently opposite the emitters so that the influence of their action on the surface state of the product is optimal.

The vibrating of the ingot mould according to a mode of propagating waves in the longitudinal direction by means, for example, of a device such as described in the already cited European Patent EP 0,178,967 and U.S. Pat. No. 4,691,757, makes it possible to overcome this high sensitivity to variations in level of the meniscus and thus to improve the reproducibility of the metallurgical results of the method. An ingot mould of conventional design is perfectly suited for this use. Moreover, the emitters may be adapted easily to an existing ingot mould without it being necessary to make major modifications thereto. However, if they are placed in a vertical position on the upper edge of the ingot mould, they fill part of the space which is normally free between the ingot mould and the lower part of the tundish which feeds it with molten metal. This can impede access to the meniscus, particularly with regard to devices for adjusting its level optically, for feeding it with mould powder and for observation thereof by the operators. Moreover, the emitters are thus exposed to splashes of metal coming from the meniscus. If they are placed on the lower edge of the ingot mould, the above problems no longer arise. However, by the same token, the emitters are exposed to the radiation of the product emerging from the ingot mould. Moreover, in the event of tearing of the solidified skin at the outlet of the ingot mould giving rise to a flow of molten metal, the latter is quite likely to damage the emitters.

SUMMARY OF THE INVENTION

In one particular embodiment, U.S. Pat. No. 4,691,757 suggests to subject the ingot mould simultaneously to longitudinal and torsional vibrations. Longitudinal vibrations are caused by a first set of emitters, each of which is placed in vertical position on the upper edge of the ingot mould, as previously seen. Torsional vibrations are caused by a second set of emitters, each of which is placed in horizontal position against a lateral wall of the ingot mould and close to a corner of said mould. Such an embodiment enlarges the possibilities of making the mould vibrate, but combines the drawbacks of both previously seen modes of placing emitters.

The invention proposes to reconcile longitudinal and transversal modes of exciting the ingot mould so as to increase the efficiency of its vibration while benefiting from advantages which are not found in either of the two known modes, and avoiding or limiting the respective drawbacks of said modes.

To this end, the subject of the invention is a method for continuous casting of metals, particularly steel, of the type according to which ultrasonic vibrations are applied to the wall of the ingot mould, characterized in that the vibrations comprise both a component which is oriented parallel to and a component which is oriented perpendicular to the axis of the ingot mould.

A further subject of the invention is a device for vibrating an ingot mould for the continuous casting of metals, of the type comprising at least one ultrasound emitter capable of emitting in a specific direction and placed at one of the ends of the ingot mould, characterized in that it comprises at least one surface integral with the ingot mould and with an angle of inclination relative to the axis of the latter, and against which the emitter is applied, the ultrasound emission direction of which is perpendicular to the surface.

This surface preferably consists of a bevelled edge of a ring surrounding the perimeter of one end of the ingot mould. This ring may be attached to the ingot mould or may be incorporated during manufacture in the ingot mould.

As will have been understood, the invention consists in orienting the ultrasound vibrations communicated by each of the ultrasound emitters to the ingot mould obliquely such that they propagate both in the longitudinal direction of the ingot mould and in the transverse direction thereof. The vibrations of the ingot mould thus themselves have a longitudinal component and a transverse component, unlike the vibrations generated by means of conventional devices, which notably have only one or the other of these two components. This particular kind of vibrations is obtained by means of a unique emitter, or a unique set of emitters which are disposed each in a similar manner on the periphery of the ingot mold.

By arranging the ultrasound emitters obliquely relative to the casting axis, the vertical dimension of the device for vibrating the ingot mould is reduced. If they are positioned on the upper edge of the ingot mould, the drawbacks of this positioning are minimized. Moreover, by transmitting these oblique vibrations to the ingot mould, a movement is generated therein which is a compromise between that achieved by purely transverse vibrations and purely longitudinal vibrations. The inventors have observed that, by suitably choosing the angle of inclination of the emitters relative to the casting axis, it was possible to arrive at a better distribution of the vibrational energy in the ingot mould than in the case in which this angle was zero, whilst retaining satisfactory transmission of the vibrations from the emitters to the ingot mould. In most cases, the optimum value of this angle of inclination, open in the direction of the upstream part of the continuous casting machine, is 60° or 120° approximately.

BRIEF DESCRIPTION OF THE DRAWING

The invention will be better understood in the light of the following description, with reference to the appended figures.

DETAILED DESCRIPTION OF THE PRESENTLY PREFERRED EXEMPLARY EMBODIMENT

Figure 1:
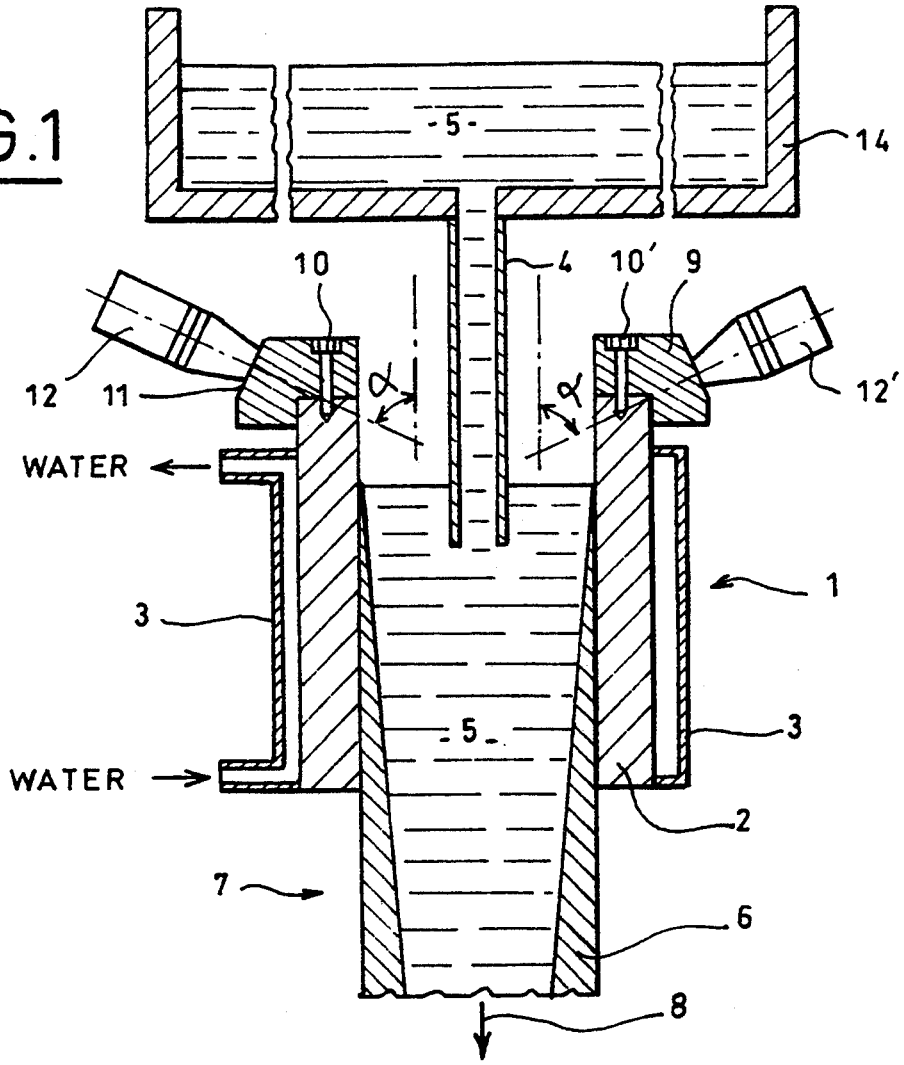
FIG. 1 shows diagrammatically, seen in longitudinal section, an ingot mould for the continuous casting of metals which is equipped with a device for vibrating according to the invention.

In FIG. 1, the ingot mould 1 comprises an inner wall 2 made from a material which is a good conductor of heat, such as copper or a copper alloy, surrounded by a sleeve 3 providing active cooling of the wall 2 by circulation of a cooling liquid, such as water. The ingot mould may have any cross-section, square, rectangular or round. It is fed with molten metal 5 via a nozzle 4 made from a refractory material connected to a tundish 14. The molten metal 5 begins to solidify against the wall 2 and to form a solid crust 6 the thickness of which increases as the product 7 is withdrawn from the ingot mould in the direction indicated by the arrow 8. The aim of vibrating the ingot mould is to improve the surface state of the product and to prevent this solid crust 6 from adhering to the wall 2 and tearing.

In the device according to the invention, the ingot mould is equipped at one of its ends with a ring 9. In the configuration shown, it is the upper end of the ingot mould which is thus equipped. This ring surrounds the perimeter of the ingot mould, to which it is secured by fastening means as symbolized by screws 10, 10'. Contact between the ring and the ingot mould must be ensured so that vibrations communicated to the ring are transmitted to the ingot mould to the greatest extent possible. The upper edge of the ring 9 is bevelled so that the ring has a surface 11 against which are applied one or, preferably, more ultrasound emitters 12, 12'. The surface 11 is oriented so that the axis of the emitters 12, 12', which is perpendicular to the surface, is inclined relative to the axis of the ingot mould by an acute angle $\alpha$ open in the direction of the upstream part of the continuous casting machine. In this manner, each of the emitters communicate to the ring and, consequently, to the complete ingot mould, vibrations oriented according to their axis and which thus have both a horizontal component and a vertical component. Part of the vibrational energy is thus used to vibrate the wall of the ingot mould in a direction perpendicular to the casting axis and to the wall of the ingot mould. The remaining vibrational energy vibrates the ingot mould in a direction parallel to the casting axis.

The proportions of the vibrational energy allocated to the transverse movements and to the longitudinal movements depend on the choice of the value of the angle $\alpha$.

In respect of the case in which the ultrasound emitters are applied directly and vertically to the upper edge of the ingot mould, the device described makes it possible to reduce the vertical dimension of the apparatus. It also makes it possible to distance the emitters from the meniscus and thus to reduce their exposure to splashes of molten metal coming from the meniscus. In order to improve this protection and to shield the emitters from the radiation coming from the nozzle 4, it is also possible to install a cover which does not excessively impede access to the inside of the ingot mould.

Figure 2:
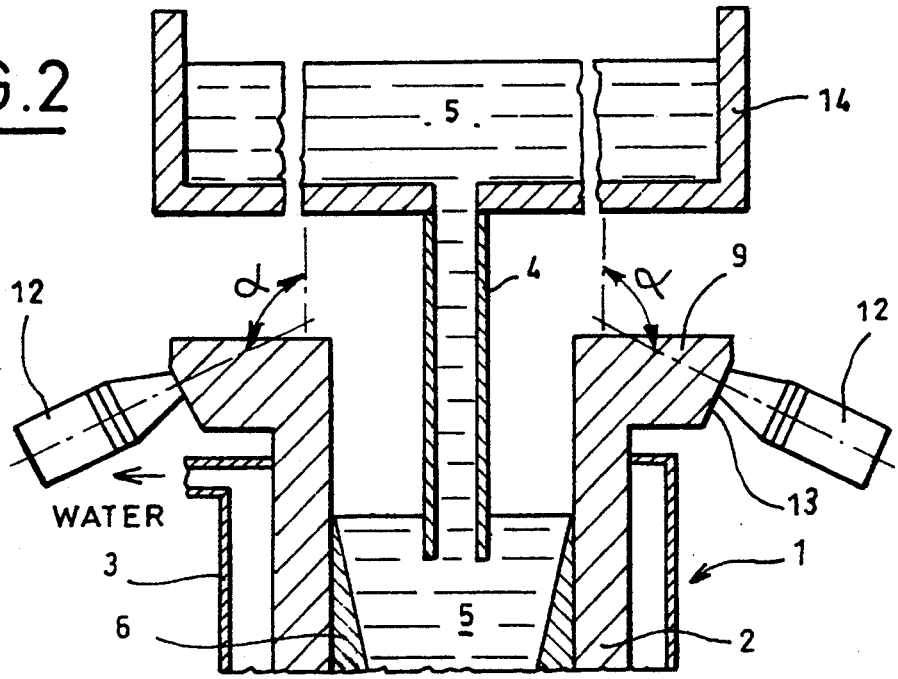
FIG. 2 shows, in the same manner, the upper part of an ingot mould equipped with an alternative embodiment of the preceding device.

According to the alternative embodiment shown in FIG. 2, the ring 9 is not attached to the ingot mould but forms an integral part thereof. Moreover, it is not the upper edge of the ring 9 which is bevelled, but its lower edge. A surface 13 facing towards the bottom of the continous casting machine is thus formed on the ring. The ultrasound emitters (12,12') are applied to the face 13. The angle $\alpha$, open in the upstream direction of the machine, is thus, this time, an obtuse angle. This configuration is particularly advantageous because, in this manner, the vertical dimension of the vibration device is limited to the excess thickness introduced by the ring 9. Moreover, the ultrasound emitters are even better shielded from splashes of molten metal than in the preceding configuration and are no longer exposed to the radiation of the nozzle 4.

If for any reason it is impossible or undesirable to install the vibration device at the upper part of the ingot mould, it is then possible to position it at the lower part thereof. Such a placement would, however, give rise to the drawbacks cited above, although to a lesser degree than in the case of conventional devices. In fact, as one of the effects of the device according to the invention is to distance the ultrasound emitters from the cast product, it becomes easier to provide means for protecting the emitters against the radiation of the product and flows of molten metal.

The vibrations emitted by the emitters are preferably high-power ultrasonic vibrations of a frequency which is at least 16 kHz in order to prevent excessive noise pollution. The ultrasound emitters are of any type known per se, such as piezoelectric transducers, which are to be recommended because of their ability to supply high power levels over a period of time.

The number of ultrasound emitters must be chosen so as to ensure satisfactory symmetry of the vibrating of the ingot mould, in order to guarantee a sufficiently uniform reduction of the frictional forces over all the portions of the ingot mould. Thus, in the case of ingot moulds for casting blooms or billets, the presence of at least one emitter per face is recommended. In the case of ingot moulds for casting slabs, each large face may be equipped with several emitters, if the vibrations emitted by a single emitter placed in the centre of the large face suffer excessive damping before reaching the lateral ends of the large face. If the ingot moulds have a circular section, two emitters placed in diametrically opposite positions may be sufficient, if the diameter of the ingot mould is not too large.

Naturally, the invention is not limited to the examples which have just been described and represented. It is applicable to conventional continuous-casting ingot moulds of all types, straight of curved, vertical or horizontal, for the production of products of all sizes: billets, blooms, slabs, or even for the direct casting of thin products. In particular, an alternative embodiment of this device would consist in not using a continuous ring, but a plurality of bevelled pieces, each one of which would carry at least one emitter oriented as has Just been described. However, due to the inevitable differences in the frequencies of the emitters, in the features of these various bevelled pieces, and in the quality of their contact with the ingot mould, there is a risk of beat phenomena being established, which could be prejudicial to satisfactory operation of the installation. However, such an alternative embodiment may be applied when the particular construction of the ingot mould needs to minimize its friction with the product only over a portion of its perimeter. This is the case, for example, in ingot moulds for continuous casting between two rotating rolls. In this case, only the stationary plates ensuring the lateral closing of the ingot mould lend themselves to being vibrated by means of the device which has Just been described.

Figure 3:
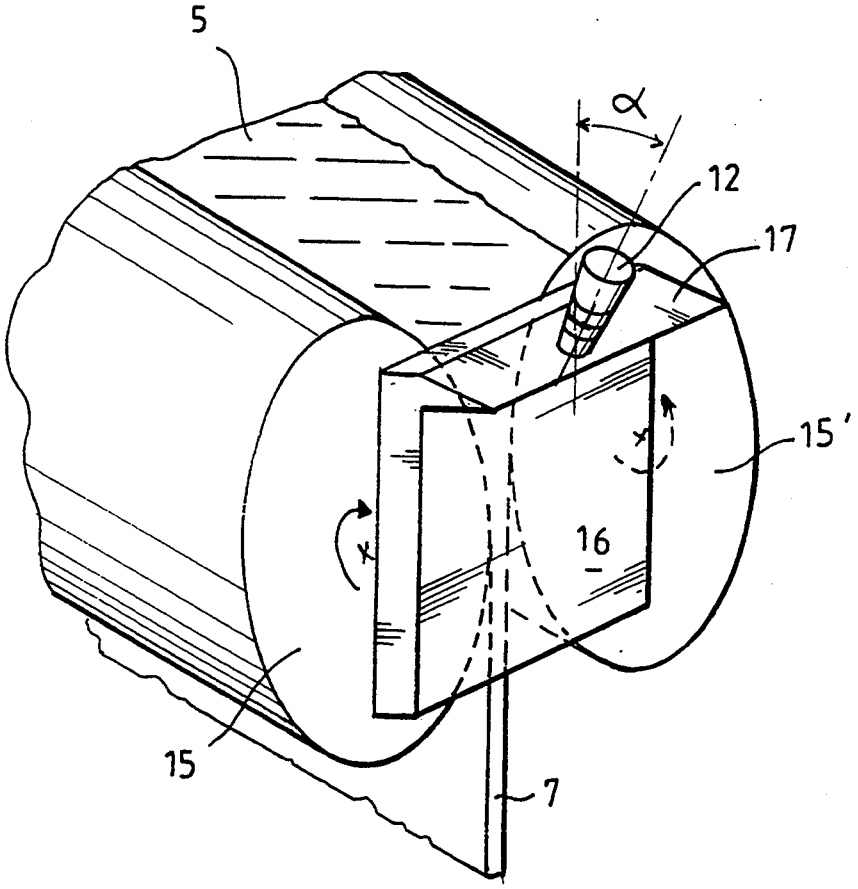
FIG. 3 illustrates a perspective view of an ingot mould of the type including two rotating rolls, and two lateral closure plates, the invention being included in the lateral closure plate of the ingot mould for continuous casting.

According to the embodiment shown in FIG. 3, the invention is included in the lateral closure plates of an ingot mould for continuous casting between two rotating rolls 15, 15'. The two rolls 15, 15' are separated by a gap into which the liquid metal 5 is cast. The end faces of the rolls 15, 15' are connected by stationary plates 16, which close the gap at the end of the rolls 15, 15'. Plates 16 include a face 17, the perpendicular direction of which is inclined at an angle $\alpha$ from the vertical. Ultrasonic emitters 12, 12' are mounted on each of the surfaces 17 to emit vibrations perpendicular to this surface, the vibrations having both a horizontal and a vertical component.

Moreover, the particular orientation of the ultrasonic vibrations may be obtained by any means indepedent of the ingot mould and incorporated into the ultrasound emitters. The latter would thus communicate, to the ingot mould, an excitation oriented obliquely relative to the axis of the emitters. The portions of the ingot mould supporting the emitters would then not necessarily be oriented obliquely relative to the axis of the ingot mould.

This method and this device may be used alone or in conjunction with other means for reducing the risks of sticking of the solidified skin to the walls of the ingot mould, such as low-frequency mechanical oscillations and lubrication of the walls with oil or a meniscus covering slag.

I claim:

1. A device for vibrating a wall of an ingot mould for the continuous casting of metals, said device comprising:

at least one ultrasound emitter for emitting in a specific direction and placed at one end of the ingot mould; and at least one surface integral with the ingot mould;

wherein said emitter is applied against the surface so that the ultrasound emission direction is perpendicular to said surface;

wherein said surface is oriented so that an axis of said emitter, which is perpendicular to said surface, is inclined by an angle $\alpha$ relative to an axis of the ingot mould, wherein $\alpha$ is substantially different than 0° and substantially different than 90°; and wherein said surface includes a bevelled edge of a ring surrounding the perimeter of one end of the ingot mould.

2. A device according to claim 1, wherein said ring is attached to the ingot mould.

3. A device according to claim 1, wherein said ring is incorporated during manufacture in the ingot mould.

4. A device according to claim 1, wherein said angle $\alpha$ has a value of about 60° and opens in the upstream direction of the continuous casting machine.

5. A device according to claim 1, wherein said angle $\alpha$ has a value of about 120° and opens in the upstream direction of the continuous casting machine.

6. A device according to claim 1, wherein said emitter is a piezoelectric ultrasound emitter.

7. A device for vibrating a wall of an ingot mould for the continuous casting of metals, said device comprising:

at least one ultrasound emitter for emitting in a specific direction and placed at one end of the ingot mould; and at least one surface integral with the ingot mould;

wherein said emitter is applied against the surface so that the ultrasound emission direction is perpendicular to said surface;

wherein said surface is orientated so that an axis of said emitter, which is perpendicular to said surface, is inclined by an angle $\alpha$ relative to an axis of the ingot mould, wherein $\alpha$ is substantially different than 0° and substantially different than 90°; and wherein said angle $\alpha$ provides means for allowing said emitter to impart both (1) a component of emitted ultrasonic waves perpendicular to said wall for causing vibration of said wall substantially exclusively in a direction corresponding to a direction of propagation of said perpendicular component and (2) a component of emitted ultrasonic waves parallel to said wall.

8. A device according to claim 7, wherein the emitter is a piezoelectric ultrasound emitter.

9. A device for vibrating a wall of an ingot mould for the continous casting of metals, said device comprising:

at least one ultrasound emitter for emitting in a specific direction and placed at one end of the ingot mould; and at least one surface integral with the ingot mould;

wherein said emitter is applied against the surface so that the ultrasound emission direction is perpendicular to said surface; and wherein said surface is orientated so that an axis of said emitter, which is perpendicular to said surface, is inclined by an angle $\alpha$ relative to an axis of the ingot mould, wherein $\alpha$ is substantially greater than 0° and substantially less than 90°;

wherein said angle $\alpha$ provides means for allowing said emitter to impart both (1) a component of emitted ultrasonic waves perpendicular to said wall for causing vibration of said wall substantially exclusively in a direction corresponding to a direction of propagation of said perpendicular component and (2) a component of emitted ultrasonic waves parallel to said wall;

wherein said device is used with lateral closure plates of said ingot mould for continuous casting between two rotating rolls.

10. A device according to claim 7, 1 or 9, wherein said angle $\alpha$ has a value of about 60° and opens in the upstream direction of the continuous casting machine.

11. A device according to claim 7, 1 or 9, wherein said angle $\alpha$ has a value of about 120° and opens in the upstream direction of the continuous casting machine.

12. A device for continuously casting a metal product, comprising:

means having an interior and an exterior surface, for containing said metal product during solidification, said containing means including walls of an ingot mold; and means for applying ultrasonic vibrations to said walls of an ingot mold, said applying means including (a) means for producing ultrasonic waves said producing means being disposed so as to be inclined by an angle $\alpha$ with respect to said walls and (b) means for simultaneously imparting both (1) a component of said ultrasonic waves perpendicular to said walls for causing vibration of said walls substantially exclusively in a direction corresponding to a direction of propagation of said perpendicular component and (2) a component of said ultrasonic waves parallel to said walls.

13. A device for continuously casting a metal product, comprising:

means having an interior and an exterior surface, for containing said metal product during solidification and constituting walls of an ingot mold; and means for applying ultrasonic vibrations to said walls of said ingot mold, said applying means including (a) means for producing ultrasonic waves and (b) means for simultaneously imparting both (1) a component of said ultrasonic waves perpendicular to said walls for causing vibration of said walls substantially exclusively in a direction corresponding to a direction of propagation of said perpendicular component and (2) a component of said ultrasonic waves parallel to said walls.

* * * * *